United States Patent [19]

Rivera

[11] Patent Number: 5,036,578

[45] Date of Patent: Aug. 6, 1991

[54] CUTTING, STRIPPING AND WIRE-WRAPPING HAND TOOL

[75] Inventor: Tom Rivera, Bronx, N.Y.

[73] Assignee: OK Industries Inc., Yonkers, N.Y.

[21] Appl. No.: 536,218

[22] Filed: Jun. 11, 1990

[51] Int. Cl.[5] ..... H01R 43/033

[52] U.S. Cl. ..... 29/566.4; 7/107; 29/751; 29/758; 81/9.4; 140/124

[58] Field of Search ..... 140/119, 122, 124; 29/33 F, 566.4, 751, 758; 81/9.4; 7/107

[56] References Cited

U.S. PATENT DOCUMENTS

| | | | |
|---|---|---|---|
| 3,625,262 | 10/1971 | Baker et al. | 140/124 |
| 3,696,482 | 10/1972 | Tumilty . | |
| 3,781,932 | 1/1974 | Baker et al. | 7/14.1 R |
| 3,829,951 | 8/1974 | Nagayama | 29/566.2 |
| 3,903,936 | 9/1975 | Bergmann | 140/124 |
| 3,967,357 | 7/1976 | Bolssens et al. | 29/566.4 |
| 4,329,777 | 5/1982 | Murphy | 29/751 |
| 4,380,111 | 4/1983 | Galloup et al. | 7/14.1 R |

*Primary Examiner*—Steven C. Bishop

*Attorney, Agent, or Firm*—Rosen, Dainow & Jacobs

[57] ABSTRACT

A cut, strip and wrap tool for removing insulation from a wire while wrapping about a terminal, comprising on a rotatable bit a wire-receiving slot which is circumferentially offset from a sleeve window at one end to a cutter at the opposite end. The bit configuration is such that both left hand and right hand loading of the wire by the operator is allowed.

11 Claims, 4 Drawing Sheets

CUTTING, STRIPPING AND WIRE-WRAPPING HAND TOOL

This invention relates to a cutting, stripping and wrapping hand tool for wire-wrapping a solid flexible insulated conductive wire about a terminal post.

BACKGROUND OF THE INVENTION

There exist a number of commercially available cut, strip and wrap tools. Their use is for wire-wrapping electrical conductors about a terminal post typically mounted on terminals, connectors, terminal boards or printed circuit boards for mounting electrical components. In use, the operator loads an insulated wire into a wire receiving cavity in the front end face of a rotatable wrapping bit surrounded by a fixed sleeve mounted on a gun-type electrical or pneumatic hand tool, pushes the wire through a wire slot on the bit until it exits from a window at the sleeve rear, then pulls the wire into a notch at the sleeve front end, pushes the tool onto the terminal, which enters a terminal receiving bore in the bit, and then presses the gun trigger. This causes the bit to rotate within the sleeve, pulling the wire free end back through the tool. In this process, a cutter in the sleeve window cuts the wire end to define a predetermined wire length, and an insulation stripper on the bit close to its end face strips off the insulation, and the resultant bare wire is wrapped around the terminal. Various sleeve and bit configurations have been patented. U.S. Pat. Nos. 3,781,932; 4,329,777; and 4,380,111 are examples of several configurations.

The known tools exhibit various drawbacks. As examples, some of the known tools do not readily permit loading of the wire from either the right or left side; cutting of the wire is not always optimum, which sometimes distorts the conductor shape at the cut end; the insulation is not always cut all the way around before the stripping action.

SUMMARY OF INVENTION

An object of the invention is a cut, strip and wrap tool that is relatively simple to manufacture and thus of low cost yet satisfactorily performs its required functions.

A further object of the invention is a cut, strip and wrap tool that is readily loaded from either the left or right side.

Another object of the invention is a cut, strip and wrap tool that automatically positions the wire over the stripper without relying on coaction of the stripper and sleeve surfaces.

A further object of the invention is a cut, strip and wrap tool in which the insulation is cut substantially all the way around before stripping.

Still another object of the invention is a cut, strip and wrap tool which provides improved wire cutting by a shearing rather than a chisel cutting action.

Still a further object of the invention is a cut, strip and wrap tool which provides less stress on the wire during wrapping thereby reducing damage to or breakage of the wire.

These and further objects and advantages of the invention are achieved by a novel bit and sleeve configuration comprising, in accordance with one aspect of the invention, a wire receiving cavity that is slightly offset with respect to the sleeve window, and thus the wire-receiving slot in the bit follows a slightly curved or helical path from the cavity to the window.

In accordance with another aspect of the invention, the tool is configured to allow the wire to freely rotate within the stripper, which thus assures substantially 360° of insulation cutting.

In accordance with still another aspect of the invention, the stripping cutter comprises essentially two straight edges intersecting at an acute angle.

SUMMARY OF DRAWINGS

Other features and advantages will be apparent from the following detailed description of an exemplary embodiment of the tool of the invention, taken in conjunction with the accompanying drawings, wherein.

DETAILED DESCRIPTION OF PREFERRED EMBODIMENT

Reference is made to U.S. Pat. Nos. 3,625,262 and 3,696,482 for background for the invention. The bit and sleeve assembly of the present invention possess the same kinds of end structures common of an electrical or pneumatic wire-wrapping gun and thus it is unnecessary to provide a description thereof. The assembly of the present invention differs from the known constructions in the configuration of the bit-sleeve assembly extending from the sleeve window to the working end face, and the description that follows will focus on that forward portion of the assembly. This is generally illustrated in the partially cut-away plan view of FIG. 1 and the cross-sectional view shown in FIG. 2 along the longitudinal axis of FIG. 1.

Figure 1:
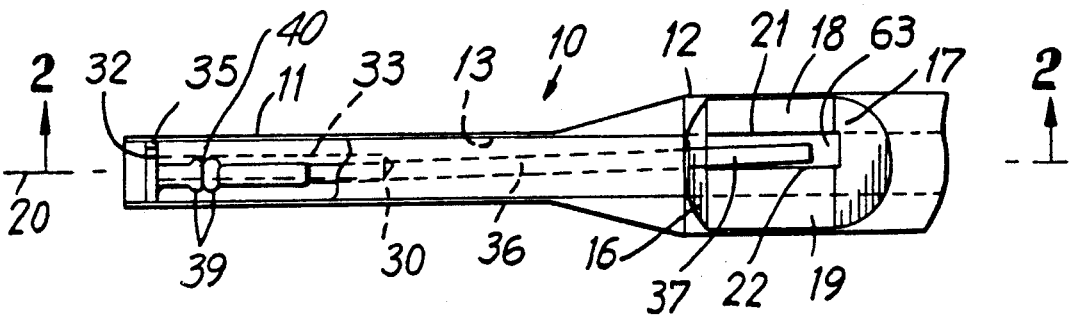
FIG. 1 is a top, partially cut-away view of the front end of one form of an assembled bit and sleeve in accordance with the invention.
Figure 2:
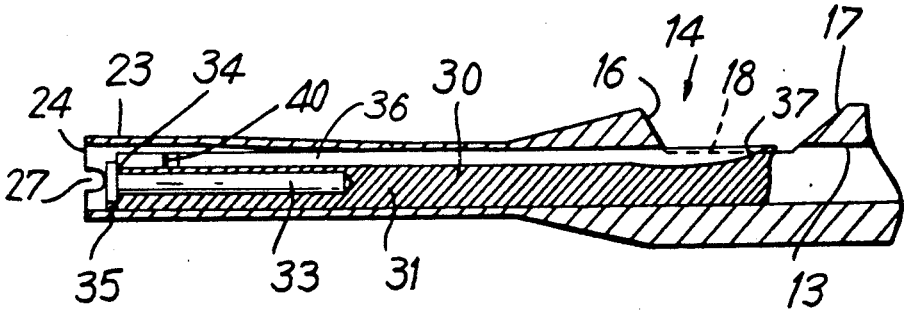
FIG. 2 is a cross-sectional view along the line 2—2 of the assembly of FIG. 1.

A one-piece elongated tubular sleeve 10 comprises a narrow forward portion 11 connected to a wider rear portion 12. For coarser wire gage sizes, the sleeve diameter may not be smaller than the rear portion 12. The remote end broken off at the right side of FIGS. 1 and 2 is configured in the conventional way to mount in a fixed position to the tool. A continuous bore 13 runs lengthwise through the sleeve. A side window 14 is cut into the sleeve wall to expose the bore 13. The window 14 is defined by front 16 and rear 17 and two side surfaces 18, 19. The side surfaces 18, 19 are flat and in a plane parallel to the sleeve longitudinal axis, designated 20. The rear surface 17 slopes backward, preferably at an angle of 40°–50°, which is not critical. The front surface 16 slopes forward at an angle of 50°–70°, preferably 60°.

The flat surfaces 18, 19 form sharp edges 21, 22 at their junction with the bore 13. These edges 21, 22 should be maintained sharp because they contribute to the shearing action on the wire.

At the forward end 11 of the sleeve, the sleeve wall at the top is bulged to form a snout 23 extending to the working face 24 of the sleeve. Two U-shaped notches 26, 27 are cut at opposite sides of the sleeves. The notches 26, 27 open to the forward end and are sized to accommodate the wire to be wrapped.

Rotatably journalled within the sleeve is a bit 30. The bit comprises an elongated shaft member whose longitudinal axis coincides with that 20 of the sleeve, and whose remote end, cut off at the right side, is configured in the conventional manner for mounting in the tool. The bit 30 comprises a constant diameter forward part 31 which fits with a small clearance within the sleeve bore 13. Extending from the working face 32 of the bit is a blind hole 33 which terminates internally of the bit. The hole 33 is offset vertically below the axis 20, and is offset horizontally to the left of the axis 22, viewed from the front, and is sized to receive the terminal post about which the wire will be wrapped. The hole 33 at the bit end face is widened or bevelled 34. A semi-circular wall 35 surrounds and projects a short distance forward from the bit end face 32. Extending longitudinally along the outer surface of the bit is a slot 36. The bottom wall of the slot 36 slopes upward 37 to the bit surface at a location opposite to the sleeve window 14. An insulation cutter 40 is mounted in the outer slot 36 close to its front end, formed in part by machine cuts 39 across the slot 36.

Figure 3:
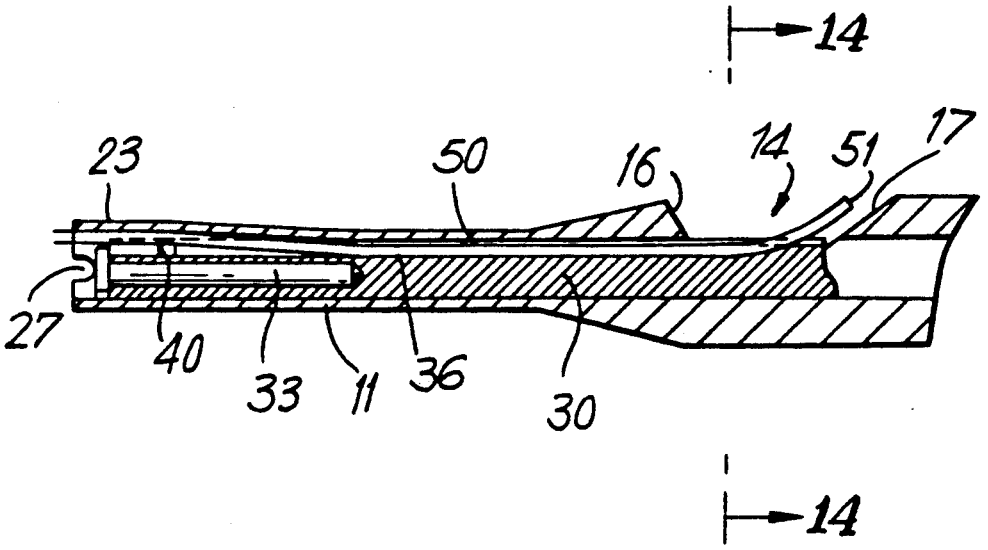
FIG. 3 is a view similar to FIG. 2 showing a wire in position prior to operating the tool.

To appreciate the inventive features, it would be helpful to briefly describe operation of the tool. As illustrated in FIG. 3, the operator pushes an insulated wire 50 into the snout opening, which causes the wire to pass over the cutter 40 and as the snout gradually disappears forces the wire into the slot 36. The operator continues to push the wire until its free end 51, following the slope 37 where the slot ends, exits as shown through the window 14. The operator then bends the wire 50 into one of the notches 26, 27, pushes the tool onto the terminal (not shown) which enters the bore 33, and activates the tool. The rotating bit 30 wraps the wire about the terminal. Since the operator-held wire end is fixed, the free end of the wire starts to pull back into the slot 36. The rotating action has also forced the insulated wire into a slot in the cutter 40. The rotating bit carries the wire in its slot in a circumferential path. The free end of the wire is caught by the edge 21 and severed. As the wire is pulled through the slot 36 to the left in FIG. 3, the insulation is stripped off and remains behind in the slot. The resultant bare wire when wrapped around the terminal is cut into by the terminal corners to form a solid reliable connection. The left-behind insulation is pushed out of the slot via the window when the next wire is inserted.

The principal features of the invention are directed to the sleeve window configuration, the configuration of the stripping cutter, and the orientation and configuration of the tool front end. The object is to ease use of the tool by the operator, allow the operator to load the tool from either the left or right side, improve stripping of the insulation, and improve cutting of the wire. These objects are accomplished by the combination of several or all of the following features:

1. When the wire is loaded by the operator into the bit-sleeve assembly, the wire is positioned directly over the insulation stripper. Its positioning is not dependent on co-action of stripper portions and snout angles as in some commercial tools, nor on a bearing structure within the sleeve as in others.
2. The wire is free to rotate within the stripper when right-hand loaded (right-hand loading means that the wire exits the tool prior to making the wrap from the right hand side or in the right hand direction, using the sleeve notch on the right side—as viewed from the position of the operator with the gun pointing straight ahead; left-hand loading is a reversal of the wire with the left notch used). The stripper does not confine and lock the insulation as in some commercial tools. By first cutting the insulation substantially all the way around before stripping from the wire, stress on the wire is reduced at the moment when all the slack is taken off the wire.
3. The wire-receiving cavities in the bit are positioned differently in the front and rear. At the front, the cavity is off-center to the right as viewed from the front, which provides a more natural exit path for the wire as it leaves the stripper to be wrapped about the terminal post. At the rear, behind the stripper, the cavity or wire slot forms a small twist or helix which gradually brings the wire slot to the center as it exits through the sleeve window. This has the advantage that the helical shape of the rear wire slot provides a shearing action when cutting the wire, which makes for a cleaner cut and avoids burs. This is in contrast to some commercial tools which provide a slamming or chisel cutting action on the wire.
4. The tool design allows for right-hand as well as left-hand loading of the wire. Most commercial tools only permit left-hand loading. Right-hand loading is desirable when routing the wire from a first terminal to a second terminal to the left of the first. This is accomplished or facilitated by reducing the sharpness of the turn the wire must make while wrapping to reduce wire stress and lessen the chance of breakage.

Figure 4:
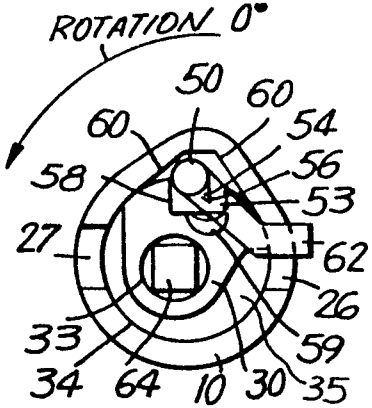
FIGS. 4–13 show the front end of the assembly while wrapping a left-hand loaded wire in respective bit positions of 0°, 5°, 10°, 20°, 30°, 60°, 120°, 180°, 270° and 300°.
Figure 5:
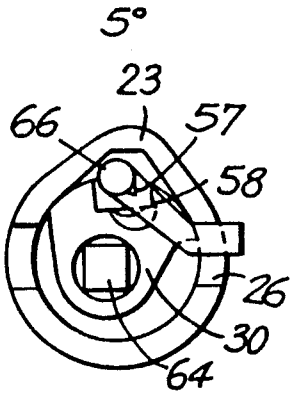
Figure 6:
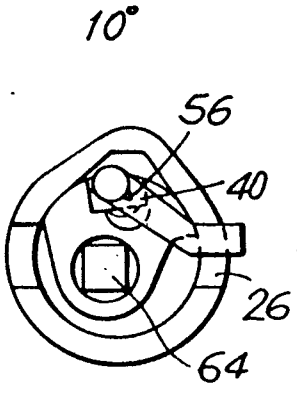
Figure 7:
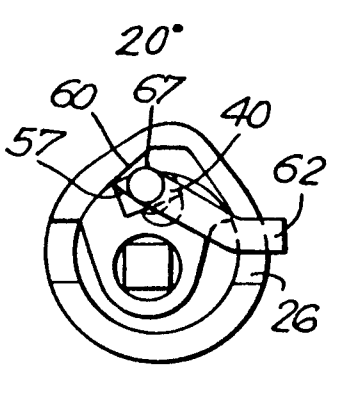
Figure 8:
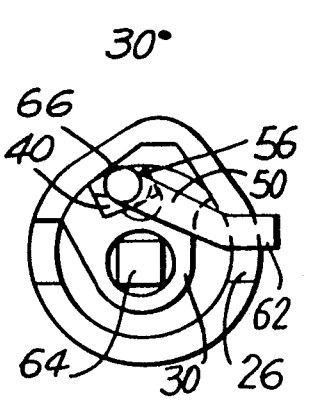
Figure 9:
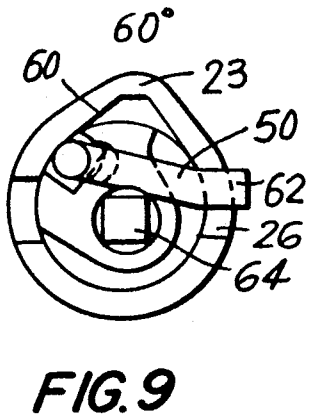
Figure 10:
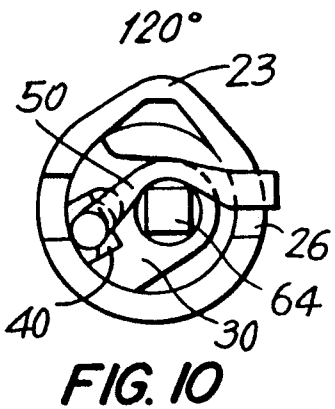
Figure 11:
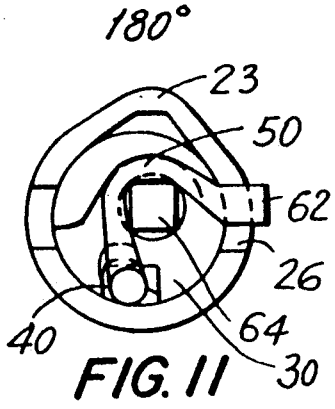
Figure 12:
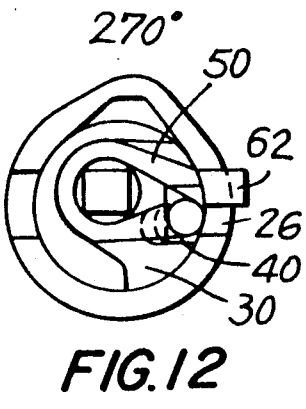
Figure 13:
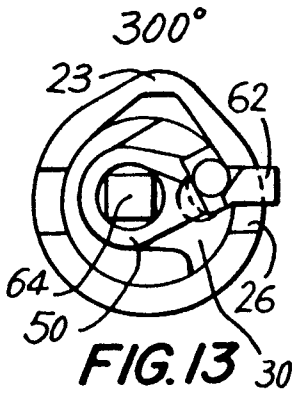

The slight helical configuration of the wire cavity is difficult to illustrate in the drawings. FIG. 1, however, does show the rear end of the slot 37 exactly centered over the longitudinal axis 20. FIG. 4 is a front view of the tool of FIG. 1 with the bit in the same position. For completeness' sake, it should be mentioned that the gun chuck end is provided with a conventional mechanism that always positions the bit after rotation in the rest position illustrated in FIG. 1, with the slot 36 centered under the window 14. In this bit rest position, called the 0° position, as shown in FIG. 5, the snout 23 is circumferentially offset CW from the vertical (viewed from the front) about 10°. This can vary between about 8°–12°. The offset is in a direction opposite to the direction of rotation of the bit during wrapping, which is CCW in FIG. 4 as shown by the arrow. Thus, from the position of the stripper 40 to the sloped surface 37, the slot 36 smoothly follows a helical path. For a typical sized bit, that distance amounts to about 1⅛ inches, so over the latter distance, the helix rotation is about 10°. The stripper 40 is recessed about ⅛ inches in from the bit end face 32. The projecting wall portion 35 serves to wipe down the wire end at its final turn.

The stripper 40 (FIG. 4) comprises a thin vertical wall 53 in the slot 36, formed by machining, defining a stripper slot 54 defined by two straight cutting edges 56, 57 intersecting at an angle of 55° to 65°, preferably 60°. One edge 55 is vertical, extending approximately radially, and the other edge 57 slopes to the left and performs more of the cutting action. The vertical walls defining the slot portion in front of the stripper are referenced 58. Numeral 59 references a polished radial surface with a low friction coefficient at the wire exit from the wire slot. The wire slides across surface 59 as it exits the stripper and changes direction towards the terminal. The interior walls 60 of the snout 23 are shaped so that the wire 50 when loaded sits just above the stripper 40, and is confined to the area directly above the stripper by the amount of the clearance between the bit and sleeve, and will naturally fall into the stripping slot 54 as shown in FIG. 4 when the bit begins to rotate. As mentioned, the operator for left-hand loading bends the wire into the left sleeve notch 26, where it remains held by the operator during operation. That wire end is referenced 62. The terminal post when inserted is shown at 64. During operation, the terminal 64 and sleeve 10 remain fixed as the bit rotates CCW in FIG. 4. It will be understood that the wire 50 comprises a solid metal core 66 surrounded by insulation 67.

FIGS. 5-9 illustrate the insulation cutting action for bit rotations of 5°, 10°, 20°, 30°, and 60°, respectively. As the bit 30 begins to rotate, holding the wire end 62 in place effectively anchors the wire at the U notch 26 and prevents slack, and limits the arc formed by the wire during bit rotation. This forces the wire to enter the stripper slot 54. As shown in FIG. 5, stripper edges 56, 57 already begin penetrating the insulation 67 after only 5° and by the time the bit has rotated 20° (FIG. 7) and before the sleeve inner surface 60 is contacted by the wire, the wire has bottomed in the stripper and the stripper cutting edges 56, 57 have cut through one side of the insulation and reached the wire core. FIGS. 10-13 show the bit at, respectively, 120°, 180°, 270°, and 300° positions during its first revolution. The wire 50 is shown making its first turn on the terminal 64. Whatever insulation may not have been pierced by the stripper is sheared off as additional bare wire is fed from behind the stripper 40 to maintain the arc length forced on the wire by the anchor at the U notch 26.

Figure 14:
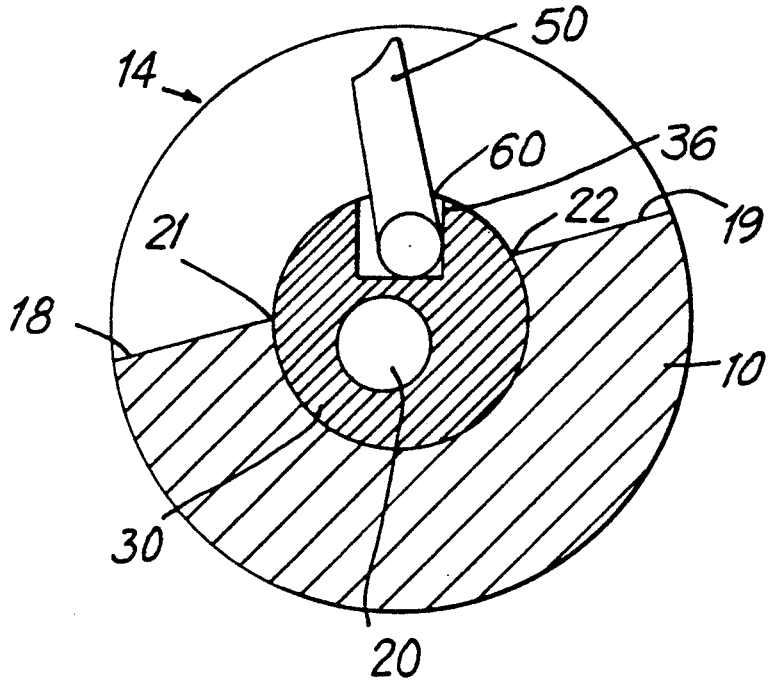
FIG. 14 is a cross-sectional view of the assembly along the line 14—14 of FIG. 3 showing the initial position of the wire with respect to the cutting edges.

Cutting of the free wire end at the sleeve window 14 takes place at approximately 52° of rotation. It is a shearing action that occurs as a result of the cutting edge 60 (See FIG. 14) of the wire slot 36, as the bit rotates (FIG. 1), pushing the wire end 51 past the cutting edge 21 at the edge of the sloped surface. This is also shown in FIG. 14, which is a cross-section across the tool at the window 14. FIG. 14 also illustrates the slot 36 offset. In the tool position of FIG. 14, the snout 23 is vertical. Due to the helical curve of the slot 36, the window surfaces 18, 19 thereby are in a plane tilted downward relative to a horizontal plane about 10°-20° to the left, which is about 70°-80° with respect to a vertical plane through the snout.

The actual wrapping of the wire about the terminal post begins at approximately 90° of bit rotation. The wire wrapping will continue for as long as the bit rotates and wire feeds out of the tool. The number of insulation turns obtained in the resultant modified wrap is controlled by the depth of the recessed stripper 40 from the bit end face, and the number of bare wire turns is controlled by the distance between the stripper 40 and the window 14. The insulation scrap remains in the wire slot 36 until being ejected through the window 14 by the next wire loading for the next wrapped connection.

The operation for right-hand loading is illustrated in FIGS. 15-20, with the operator using the right notch 27 to anchor the end. As before, the wire 50 when inserted into the tool at the spout sits just above the stripper 40 and is confined to the area directly above the stripper by the amount of clearance 69 between the bit and sleeve. This space restriction or confinement of the wire is essential for the success of right-hand loaded wraps. Unlike the smooth sequence of events which take place in the making of a left-hand loaded wrap, the wire in a right-hand loaded wrap can be subjected to a number of severe stresses which must be controlled and minimized to prevent breakage and/or undue elongation of the conductor.

Figure 15:
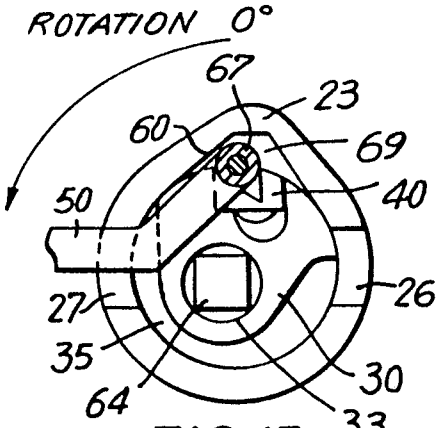
FIGS. 15–20 are views similar to FIGS. 4–13 for a right-hand loaded wire, for respective bit positions of 0°, 10°, 30°, 90°, 180°, and, 270°.
Figure 16:
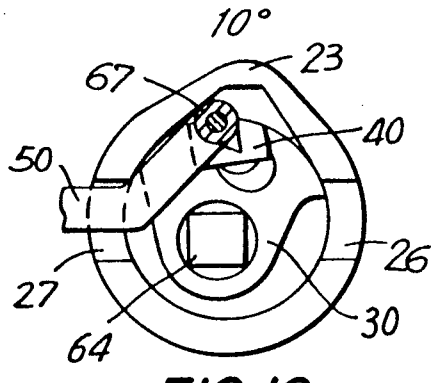
Figure 17:
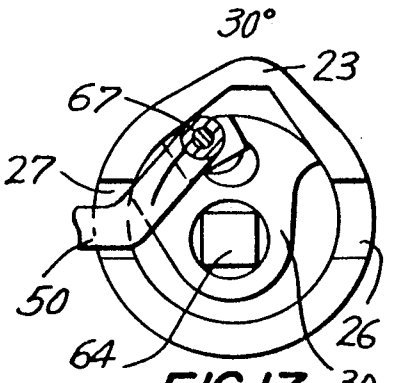
Figure 18:
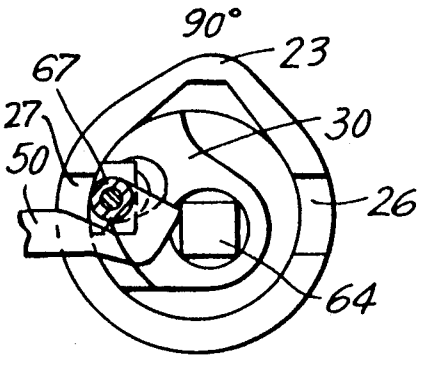

FIG. 15 shows the wire seated in the stripper 40 and anchored in the right U notch 27. As the bit 30 rotates, the stripper action begins by pushing the captive wire towards the internal wall 60 in the sleeve and also relieving the tension at the anchor point in the U notch 27. See also FIG. 16 at 70. Once the pressure at the anchor point is released, the wire 50 is forced to rotate within the stripper slot 54 by the combined forces of bit rotation and friction against the inside sleeve wall 60. The rotation of the wire within the stripper causes the insulation to be cut substantially all around the entire circumference of the wire before the actual stripping of the insulation begins. Generally, the wire rotation occurs in right-hand loaded wraps during the first approximately $\frac{3}{4}$ of a revolution while there is slack in the wire, due primarily to pinching of the insulation between the stripper 40 and the inner sleeve wall.

Figure 19:
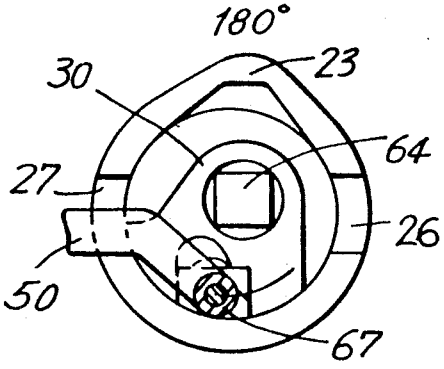
Figure 20:
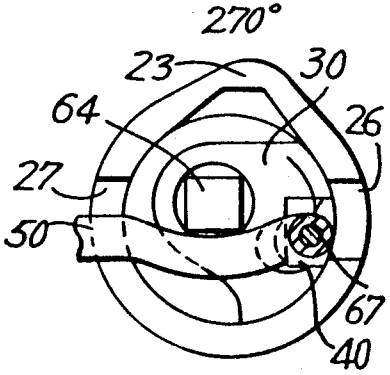

FIGS. 16-20 show the severe twisting the wire 50 undergoes before it starts to make its first turn. This is a result of the bit 30 always rotating CCW for both left hand and right hand loaded wires. The wrap around the terminal post 64 begins when the wire is firmly reanchored in the notch 27 but at its opposite edge at about 270° from the 0° starting position, as shown in FIG. 20. As shown by FIGS. 17 through 20, the wire 50 must also push the end out of the way and execute a loop to assume the correct wrapping position. Coming out of the loop (FIGS. 19 and 20) a snapping action occurs which could easily break or elongate the wire if not for the cutting of the insulation around the entire circumference as described above. If the insulation were not cut substantially all the way around, the stripping would occur partially as the result of tearing. This is undesirable. By substantially complete cutting of the insulation, the metal conductor can slide easily out of the wire and stress on the wire at snapout is greatly reduced. From the 270° position onward, the wire feeds out of the tool and is wrapped around the terminal post 64 in the conventional manner.

As will also be clear from the drawings, by locating the terminal receiving opening 33, viewed from the front, left of the center of the bit 30, while locating the wire slot 36 to the right of the center of the bit 30, the degree of turn required of the wire to go from the position shown in FIG. 15 to that shown in FIG. 19 is reduced, which produces less stress in the wire and thus a smaller likelihood of damage and breakage.

While the invention has been described and illustrated in connection with preferred embodiments, many variations and modifications as will be evident to those skilled in this art may be made therein without departing from the spirit of the invention, and the invention as set forth in the appended claims is thus not to be limited to the precise details of construction set forth above as such variations and modifications are intended to be included within the scope of the appended claims.

What is claimed is:

1. A cut, strip and wrap tool for stripping insulation from a flexible conductive wire and wrapping said wire about a terminal, comprising:

(a) an elongated cylindrical tubular sleeve having a front end and a rear portion, said sleeve having a window at said rear portion and at least one notch at its front end, (b) a rotatable wrapping bit extending within the tubular sleeve and having a front face adjacent the sleeve front end, a slot extending longitudinally along its outer surface from the sleeve window to its front face and defining at its front face a wire-receiving opening for receiving an insulated wire, said bit slot being dimensioned to accommodate said insulated wire and having a guide portion opposite to the window such that a wire pushed into the bit front wire-receiving opening and along the slot will have its free end guided generally outwardly so as to pass through the sleeve window, (c) an insulation stripper located in the bit slot adjacent its front face, (d) said wire-receiving opening being slightly circumferentially offset with respect to the sleeve window, said bit slot following a slightly curved helical path from the wire-receiving opening at its front face to its guide portion opposite the sleeve window.

2. The cut, strip and wrap tool as claimed in claim 1, wherein the sleeve has oppositely-positioned left and right generally U-shaped notches.

3. The cut, strip and wrap tool as claimed in claim 1, wherein the stripper comprises a first substantially straight edge extending generally radially and a second substantially straight edge extending at an acute angle with respect to the first edge.

4. The cut, strip and wrap tool as claimed in claim 1, wherein the sleeve window comprises at least one longitudinally-extending sleeve cutting edge, and the bit slot wall portion opposite to the sleeve cutting edge defines a bit cutting edge which cooperates with the sleeve cutting edge when the bit is rotated to cause the free wire end to be cut by a shearing action.

5. The cut, strip and wrap tool as claimed in claim 1, wherein said sleeve has oppositely-positioned left and right generally U-shaped notches, said stripper comprises a first substantially straight edge extending generally radially and a second substantially straight edge extending at an acute angle with respect to the first edge; viewed from the front, said wire-receiving opening is laterally offset with respect to the bit longitudinal axis in a direction opposite to the rotation direction of said bit within said sleeve; viewed from the front, said terminal-receiving opening is laterally offset with respect to the bit longitudinal axis in the rotation direction of said bit.

6. A cut, strip and wrap tool for stripping insulation from a flexible conductive wire and wrapping said wire about a terminal, comprising:

(a) an elongated cylindrical tubular sleeve having a front end and a rear portion and a snout portion at its front end, said sleeve having a window at said rear portion and at least one notch at its front end, said sleeve window comprising lateral flat surfaces extending in a plane tilted about 10°–20° with respect to a horizontal plane through the snout, (b) a rotatable wrapping bit extending within the tubular sleeve and having a front face adjacent the sleeve front end, a slot extending longitudinally along its outer surface from the sleeve window to its front face and defining at its front face a wire-receiving opening for receiving an insulated wire, said bit slot being dimensioned to accommodate said insulated wire and having a guide portion opposite to the window such that a wire pushed into the bit front wire-receiving opening and along the slot will have its free end guided generally outwardly so as to pass through the sleeve window, (c) an insulation stripper located in the bit slot adjacent its front face, (d) said wire-receiving opening being slightly circumferentially offset with respect to the sleeve window, said bit slot following a slightly curved helical path from the wire-receiving opening at its front face to its guide portion opposite the sleeve window.

7. The cut, strip and wrap tool as claimed in claim 6, wherein the sleeve has oppositely-positioned left and right generally U-shaped notches, and the stripper comprises a first substantially straight edge extending generally radially and a second substantially straight edge extending at an acute angle with respect to the first edge.

8. A cut, strip and wrap tool for stripping insulation from a flexible conductive wire and wrapping said wire about a terminal, comprising:

(a) an elongated cylindrical tubular sleeve having a front end and a rear portion, said sleeve having a window at said rear portion and at least one notch at its front end, (b) a rotatable wrapping bit extending within the tubular sleeve and having a front face adjacent the sleeve front end, a slot extending longitudinally along its outer surface from the sleeve window to its front face and defining at its front face a wire-receiving opening for receiving an insulated wire, said bit slot being dimensioned to accommodate said insulated wire and having a guide portion opposite to the window such that a wire pushed into the bit front wire-receiving opening and along the slot will have its free end guided generally outwardly so as to pass through the sleeve window, (c) an insulation stripper located in the bit slot adjacent its front face, (d) said sleeve having oppositely-positioned left and right generally U-shaped notches, (e) said stripper comprising a first substantially straight edge extending generally radially and a second substantially straight edge extending at an acute angle of about 55°–65° with respect to the first edge; viewed from the front, said wire-receiving opening being laterally offset about 8°–12° with respect to the bit longitudinal axis in a direction opposite to the rotation direction of said bit within said sleeve; viewed from the front, said terminal-receiving opening being vertically offset and also laterally offset with respect to the bit longitudinal axis in the rotation direction of said bit, whereby said tool is adapted for both left hand and right hand loading of the wire.

9. The cut, strip and wrap tool as claimed in claim 8, wherein the sleeve window comprises at least one longitudinally-extending sleeve cutting edge, and the bit slot wall portion opposite to the sleeve cutting edge defines a bit cutting edge which cooperates with the sleeve cutting edge when the bit is rotated to cause the free wire end to be cut by a shearing action.

10. The cut, strip and wrap tool as claimed in claim 8, wherein said bit slot follows a curved helical path from the wire-receiving opening at its front face to its guide portion opposite the sleeve window.

11. A cut, strip and wrap tool for stripping insulation from a flexible conductive wire and wrapping said wire about a terminal, comprising:

(a) an elongated cylindrical tubular sleeve having a front end and a rear portion, said sleeve having a window at said rear portion and oppositely positioned left and right generally U-shaped notches at its front end, (b) a rotatable wrapping bit extending within the tubular sleeve and having a front face adjacent the sleeve front end, a slot extending longitudinally along its outer surface from the sleeve window to its front face and defining at its front face a wire-receiving opening for receiving an insulated wire and a terminal-receiving opening, said bit slot being dimensioned to accommodate said insulated wire and having a guide portion opposite to the window such that a wire pushed into the bit front wire-receiving opening and along the slot will have its free end guided generally outwardly so as to pass through the sleeve window, (c) an insulation stripper located in the bit slot adjacent its front face, (d) viewed from the front, said wire-receiving opening being laterally offset with respect to the bit longitudinal axis in a direction opposite to the rotation direction of said bit within said sleeve, said bit slot following a curved helical path from the wire-receiving opening at its front face to its guide portion opposite the sleeve window, (e) viewed from the front, said terminal-receiving opening being laterally offset with respect to the bit longitudinal axis in the rotation direction of said bit, the tool being adapted for both left hand and right hand loading of the wire.

* * * * *